US009284815B2

(12) United States Patent
Sharma et al.

(10) Patent No.: US 9,284,815 B2
(45) Date of Patent: Mar. 15, 2016

(54) FLOW RESTRICTOR FOR USE IN A SERVICE TOOL

(71) Applicant: Schlumberger Technology Corporation, Sugar Land, TX (US)

(72) Inventors: Ashish Sharma, Friendswood, TX (US); Stephen D. Hill, Pearland, TX (US); Bryan Stamm, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 315 days.

(21) Appl. No.: 13/720,786

(22) Filed: Dec. 19, 2012

(65) Prior Publication Data

US 2014/0096963 A1 Apr. 10, 2014

Related U.S. Application Data

(60) Provisional application No. 61/771,436, filed on Oct. 9, 2012.

(51) Int. Cl.
*E21B 33/13* (2006.01)
*E21B 34/06* (2006.01)
*E21B 43/04* (2006.01)

(52) U.S. Cl.
CPC ..... *E21B 33/13* (2013.01); *E21B 34/06* (2013.01); *E21B 43/045* (2013.01)

(58) Field of Classification Search
CPC ..... E21B 43/045; E21B 34/08; E21B 34/10; E21B 33/12; E21B 33/14
See application file for complete search history.

(56) References Cited

U.S. PATENT DOCUMENTS

| | | | | | |
|---|---|---|---|---|---|
| 2,755,862 | A | * | 7/1956 | Abendroth et al. | 166/51 |
| 3,072,204 | A | * | 1/1963 | Brown | 175/230 |
| 3,086,587 | A | * | 4/1963 | Zandmer et al. | 166/284 |
| 3,277,962 | A | * | 10/1966 | Flickinger et al. | 166/278 |
| 3,421,586 | A | * | 1/1969 | Solum | 166/51 |
| 3,466,755 | A | * | 9/1969 | Alder | 33/307 |
| 3,627,046 | A | * | 12/1971 | Miller et al. | 166/278 |
| 4,041,832 | A | | 8/1977 | Risch | |
| 4,273,190 | A | | 6/1981 | Baker et al. | |
| 4,295,524 | A | * | 10/1981 | Baker et al. | 166/278 |
| 4,519,451 | A | | 5/1985 | Gray et al. | |

(Continued)

OTHER PUBLICATIONS

Duhon et al., "New Completion Techniques Applied to a Deepwater Gulf of Mexico TLP Completion Successfully Gravel Pack an Openhole Horizontal Interval of 2400 Feet," SPE 50146 (Oct. 1988), pp. 1-11.*

(Continued)

*Primary Examiner* — Jennifer H Gay
(74) *Attorney, Agent, or Firm* — Patrick A. Traister; Jeffery Peterson

(57) ABSTRACT

A system, apparatus, and method for gravel packing a wellbore. The system includes a service tool extending through a packer that isolates a proximal annulus of the wellbore from a distal annulus thereof. The service tool defines an inner bore and a conduit, with the conduit being in fluid communication with the proximal annulus and the distal annulus. The system also includes a flow restrictor disposed in the conduit. The flow restrictor is configured to induce a first pressure drop in fluid flowing through the conduit in a first direction and to induce a second pressure drop in fluid flowing through the conduit in a second direction, with the second pressure drop being greater than the first pressure drop.

20 Claims, 8 Drawing Sheets

(56) References Cited

U.S. PATENT DOCUMENTS

| | | | | |
|---|---|---|---|---|
| 4,691,777 | A * | 9/1987 | Williamson, Jr. | 166/319 |
| 5,020,592 | A * | 6/1991 | Muller et al. | 166/187 |
| 5,176,216 | A * | 1/1993 | Slater et al. | 166/105.5 |
| 5,373,899 | A | 12/1994 | Dore et al. | |
| 5,865,251 | A | 2/1999 | Rebardi et al. | |
| 5,931,229 | A * | 8/1999 | Lehr et al. | 166/278 |
| 6,009,945 | A * | 1/2000 | Ricks | 166/242.3 |
| 6,148,915 | A | 11/2000 | Mullen et al. | |
| 6,230,801 | B1 | 5/2001 | Hill et al. | |
| 6,349,771 | B1 * | 2/2002 | Luke | 166/386 |
| 6,382,319 | B1 | 5/2002 | Hill et al. | |
| 6,571,875 | B2 | 6/2003 | Bissonnette et al. | |
| 6,631,764 | B2 | 10/2003 | Parlar et al. | |
| 6,725,929 | B2 | 4/2004 | Bissonnette et al. | |
| 6,789,623 | B2 | 9/2004 | Hill et al. | |
| 7,533,728 | B2 * | 5/2009 | Winslow et al. | 166/318 |
| 8,066,071 | B2 | 11/2011 | Sharma et al. | |
| 8,851,166 | B2 * | 10/2014 | Foubister et al. | 166/129 |
| 2002/0195253 | A1 * | 12/2002 | Hill et al. | 166/380 |
| 2007/0181188 | A1 * | 8/2007 | Branch et al. | 137/494 |
| 2008/0164028 | A1 * | 7/2008 | Winslow et al. | 166/285 |
| 2008/0236842 | A1 * | 10/2008 | Bhavsar et al. | 166/381 |
| 2011/0067861 | A1 * | 3/2011 | Clem et al. | 166/278 |
| 2012/0006563 | A1 | 1/2012 | Patel et al. | |
| 2012/0175108 | A1 * | 7/2012 | Foubister et al. | 166/250.01 |
| 2013/0248178 | A1 * | 9/2013 | Hecker et al. | 166/278 |
| 2014/0034308 | A1 * | 2/2014 | Holderman et al. | 166/279 |
| 2014/0096963 | A1 * | 4/2014 | Sharma et al. | 166/278 |
| 2014/0262207 | A1 * | 9/2014 | Lopez | 166/114 |

OTHER PUBLICATIONS

Bercegeay et al., A One-Trip Gravel Packing System; SPE 4771, 1974 (12 pages).

Duhon et al., New Completion Techniques Applied to a Deepwater Gulf of Mexido TLP Completion Successfully Gravel Pack an Openhole Horizontal Interval of 2400 Feet; OTC 8586, (May 1988) pp. 125-135.

PCT/US2013/061956, International Search Report dated Jan. 6, 2014, 12 pgs.

* cited by examiner

FLOW RESTRICTOR FOR USE IN A SERVICE TOOL

CROSS-REFERENCE TO RELATED APPLICATION

This application claims priority to U.S. Provisional Patent Application Ser. No. 61/711,436, filed on Oct. 9, 2012. The entirety of this priority provisional application is incorporated herein by reference.

BACKGROUND

In wellbore completions, it can be advantageous to dispose a gravel (or sand) pack in an annulus between a sand screen and the wellbore. Such gravel packs can act as a filter, preventing solids from the formation from proceeding through the sand screen and reaching the interior of the completion, e.g., to production tubing, etc.

Gravel packing generally includes setting a packer and depositing a gravel packing material (e.g., gravel and/or sand) in an annulus defined below the packer and between the wellbore and the gravel packing service tool. Prior to such operation, the service tool may be deployed into the wellbore and, subsequent to and/or during gravel packing, the service tool may be partially withdrawn from the wellbore. However, as this tool is deployed or retracted through the packer, it occupies an increasing or decreasing volume, respectively, in the wellbore below the packer. If the annulus above the packer remains sealed off from the wellbore below, such withdrawal and advancement of the service tool can have a piston-like effect on the wellbore below the packer, known as "swabbing." Such increasing and decreasing displacement and/or pressures on the fluid can damage the gravel pack.

To avoid this, the inner bore of the service tool is provided with a valve at its distal end, sometimes referred to as a "full bore valve." The valve is generally opened as the tool is advanced or removed, allowing pressure to communicate between the lower part of the wellbore and the portions of the wellbore above the packer. While such valves are acceptable for a wide variety of uses, during certain operations (e.g., reverse circulation to clean the wellbore annulus above the packer) the valve is closed while the service tool is moved, which can result in the undesired swabbing effect.

SUMMARY

Embodiments of the disclosure may provide systems and methods for gravel packing at least a portion of a wellbore. The system includes a service tool that extends through a packer. The service tool defines a conduit positioned such that the conduit can allow fluid communication across the packer. The system also includes a flow restrictor disposed in the conduit. The flow restrictor induces a first pressure drop in fluid flowing through the conduit in a first direction and induces a second pressure drop in fluid flowing through the conduit in a second direction, with the second pressure drop being greater than the first pressure drop. As such, the flow restrictor may allow bi-directional fluid communication across the packer via the conduit, but may limit fluid flow rates in one direction by inducing a higher pressure drop in fluid flowing in that direction than in fluid flowing in the other direction.

This summary is provided to introduce some of the concepts described below and is not intended to limit the scope of the claimed subject matter.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
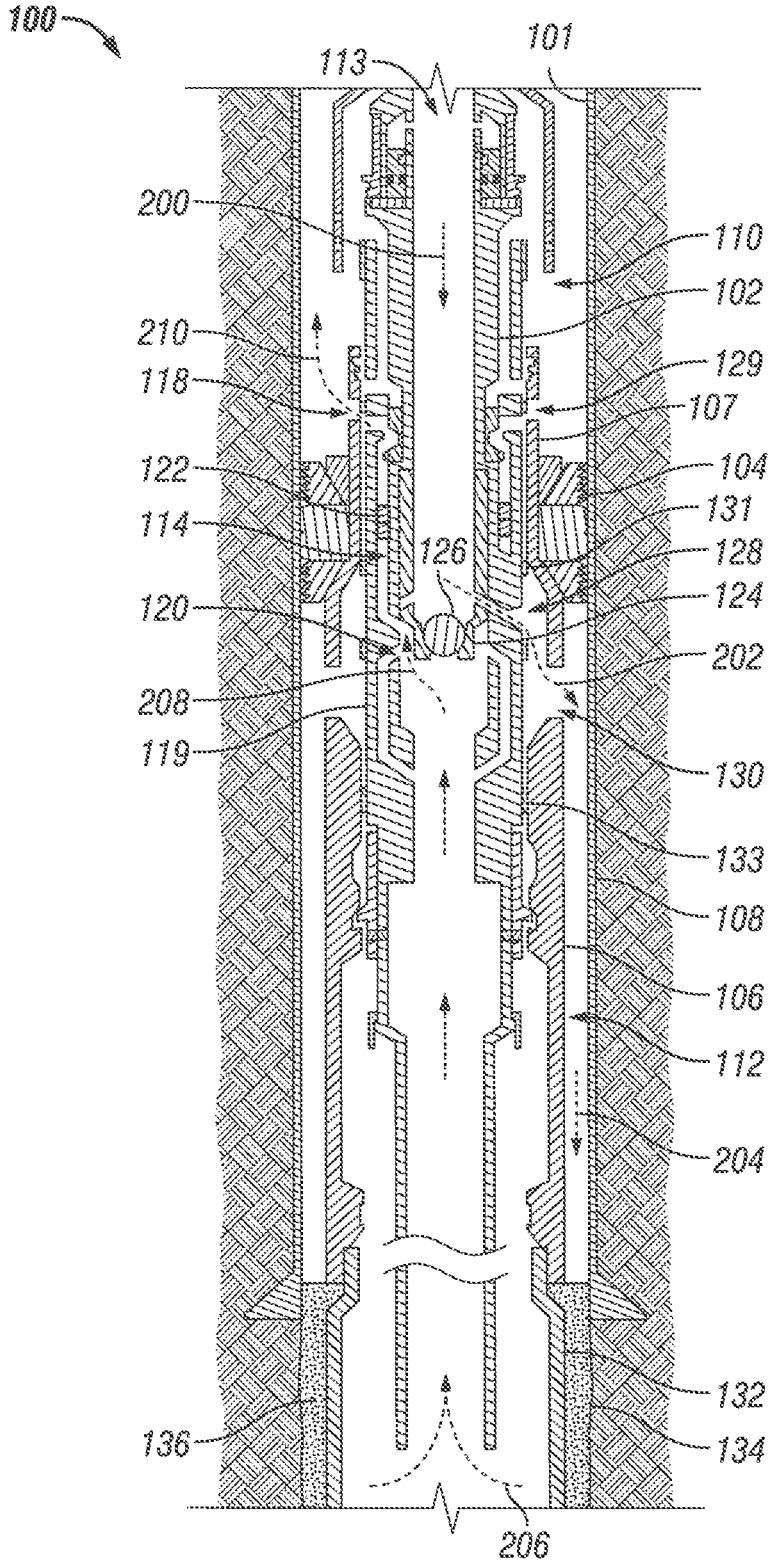
FIG. 1A illustrates a side schematic view of a gravel packing system with a service tool in a set-down, circulate position, according to an embodiment.

Embodiments of components, arrangements, and configurations are described below to simplify the present disclosure; however, these embodiments are provided merely as examples and are not intended to limit the scope of the claimed subject matter. Additionally, the present disclosure may repeat reference numerals and/or letters in the various embodiments and across the Figures provided herein. This repetition is for the purpose of simplicity and clarity and does not in itself dictate a relationship between the various embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, any element from one embodiment may be used in any other embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the present disclosure, unless otherwise specifically defined herein. Further, the naming convention used herein is not intended to distinguish between components that differ in name but not function. Moreover, the term "includes" is used in an open-ended manner, meaning "including, but not limited to."

Figure 1B:
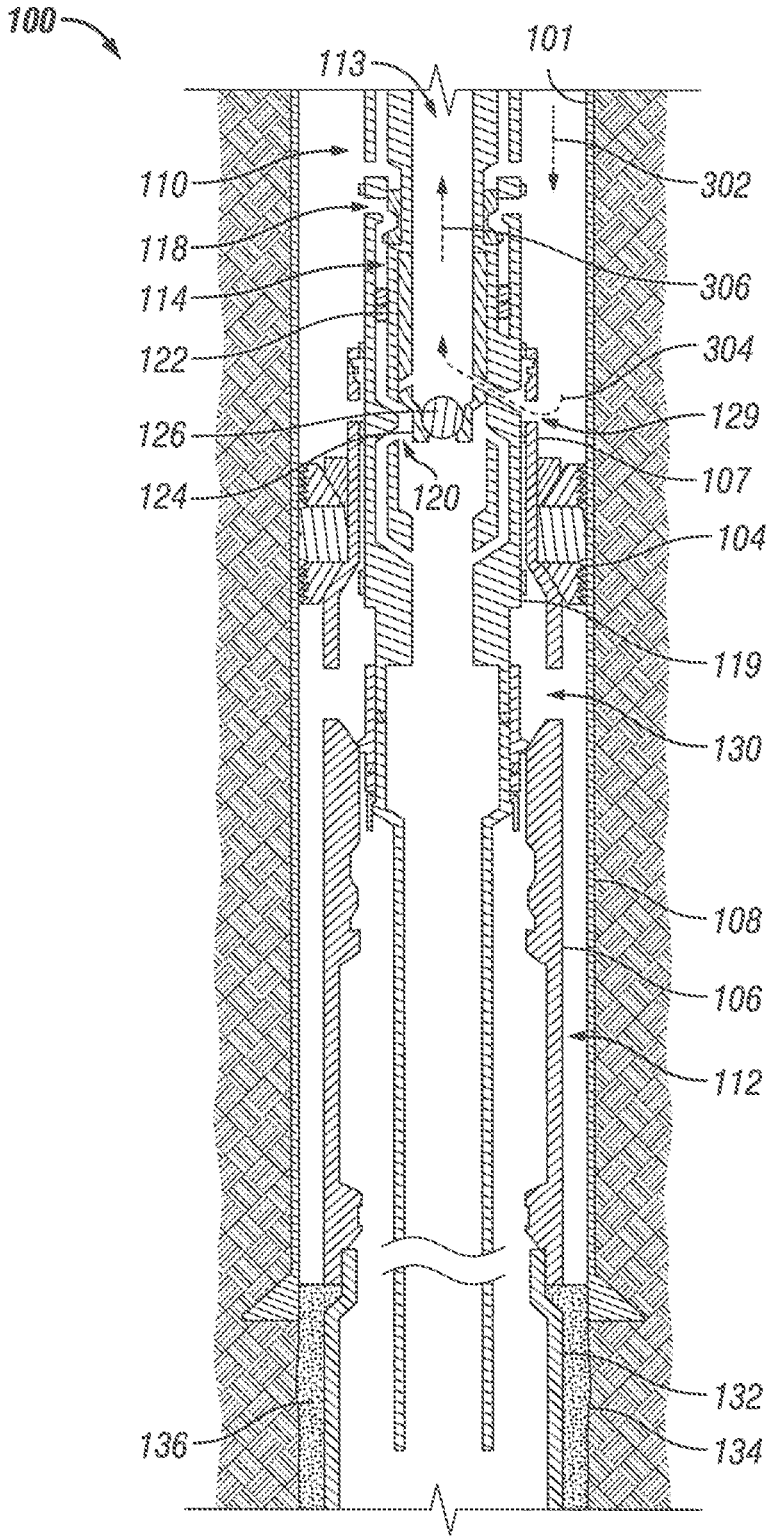
FIG. 1B illustrates a side schematic view of the gravel packing system shown in FIG. 1A, but with the service tool moved to a reverse circulation position, according to an embodiment.

FIGS. 1A and 1B illustrate simplified side schematic views of a gravel packing system 100 deployed into a wellbore 101, according to an embodiment. The gravel packing system 100 may include a service tool 102, a packer 104, and a sand screen assembly 106, among other potential components. In FIG. 1A, the service tool 102 is in a set-down, circulate position, e.g., for gravel packing operations, while in FIG. 1B, the service tool 102 is in a reverse circulation position, e.g., for clean-out operations, as will be described in greater detail below.

The service tool 102, packer 104, and sand screen assembly 106 may be run into the wellbore 101 together, with the service tool 102 stabbed into, or otherwise coupled with, the sand screen assembly 106 and the packer 104. Once positioned at a desired location, e.g., near the distal end of a casing 108 of the wellbore 101, the service tool 102 may be employed to expand the packer 104, such that the packer 104 engages the wellbore 101, e.g., the casing 108. It will be appreciated, however, that the system 100 may be readily configured for use in uncased wellbores 101. In an embodiment, the packer 104 may be a mechanical packer, which is axially compressed such that it radially expands to seal with the wellbore 101. Such compressive forces may be supplied hydraulically via the service tool 102. In other embodiments, the packer 104 may be swellable, inflatable, or may be expanded by any other device or process.

Expansion of the packer 104 and/or another "hanger" packer disposed in the wellbore 101 may secure the sand screen assembly 106 into position in the wellbore 101. Further, with the packer 104 expanded, the wellbore 101 may be divided into a proximal annulus 110 and a distal annulus 112, with the packer 104 separating or "isolating" the two annuli 110, 112, i.e., the packer 104 substantially blocks direct communication therebetween. Although the two annuli 110, 112 are shown in a vertical subjacent/superposed relationship, in some cases, the distal annulus 112 may be horizontally adjacent to the proximal annulus 110. Accordingly, it will be appreciated that the proximal annulus 110 may refer to any annulus that is disposed between the distal annulus 112 and the surface of the wellbore 101, proceeding along the wellbore 101.

In some cases, directional terms such as "up," "down," "upward," "downward," etc. may be employed herein as a matter of convenience to refer to the relative positioning of the various components as shown in the Figures. However, it is contemplated that the present system 100 may be employed in deviated, highly-deviated, and/or horizontal wellbores. As such, the terms "up," "upward," "upper," "above," and grammatical equivalents thereof are intended to refer to a relative positioning of one component being closer to the surface of the wellbore 101, as proceeding along the wellbore 101, than another component, when the components are deployed into the wellbore 101. Similarly, "down," "downward," "lower," "below," and grammatical equivalents thereof are intended to refer to a relative positioning of one component being farther away from the surface of the wellbore 101, as proceeding along the wellbore 101, than another component, when the components are deployed into the wellbore 101.

Returning to FIGS. 1A and 1B, the service tool 102 may define a central bore 113 therein, as well as one or more conduits at least partially separated from the central bore 113. For example, the service tool 102 may define a conduit 114, which may be annular in shape, extending around the bore 113. In other embodiments, the conduit 114 may have other shapes. Further, the conduit 114 may extend generally along a longitudinal axis of the service tool 102, for example, between a first tool port 118 defined in an outer diameter 119 of the service tool 102 and a bore port 120 which, unless blocked, may communicate with the central bore 113 at an axial location that is offset from the axial location of the first tool port 118.

A flow restrictor (or "flow restrictor valve") 122 may be disposed in the conduit 114. The flow restrictor 122 may be configured to induce a low pressure drop in fluid proceeding in a first direction, from the distal annulus 112, toward the proximal annulus 110. The flow restrictor 122 may also be configured to induce a high pressure drop (relative to the low pressure drop) in fluid flowing through the conduit 114 in a second direction, opposite the first direction, i.e., from the proximal annulus 110, toward the distal annulus 112. Accordingly, by inducing such high pressure drop, the flow restrictor 122 may limit fluid flow rates in this second (as shown, downward) direction.

In an embodiment, the high pressure drop may be between about 10 MPa and about 25 MPa. For example, the high pressure drop may be between about 1500 psi (10.34 MPa) and about 3000 psi (20.68 MPa). In at least one specific embodiment, the high pressure drop may be about 2000 psi (13.78 MPa). In an embodiment, the low pressure drop may be less than about 700 kPa, for example, less than about 100 psi (689 kPa). In at least one specific embodiment, the low pressure drop may be about 50 psi (345 kPa). Additional details and aspects of examples of such flow restrictor 122 will be described below.

The service tool 102 may also include a ball seat 124, which may receive a ball 126, as shown. In at least one embodiment, the ball 126 may actuate a sleeve, allowing the packer 104 to be expanded hydraulically by pumping fluid through the service tool 102. Thereafter, the ball 126 received in the ball seat 124 may substantially prevent fluid flow from proceeding through the central bore 113 to points distal to ("below") the ball 126. Instead, flow may be directed radially outward, through a second tool port 128 of the service tool 102, disposed above the ball seat 124.

Turning now to the sand screen assembly 106, the sand screen assembly 106 includes a sleeve 107 and ports, for example, a first sleeve port 129 and a second sleeve port 130, extending radially through the sleeve 107. The first sleeve port 129 may be disposed at a point between the second sleeve port 130 and the surface of the wellbore 101, as proceeding along the wellbore 101. Further, the first sleeve port 129 may be positioned to provide fluid communication between the service tool 102 and the proximal annulus 110 after the packer 104 is set. The first sleeve port 129 may be run into the wellbore 101 in the closed position to allow for circulation while running the gravel packing system 100 into the wellbore 101.

The second sleeve port 130 may be positioned to provide fluid communication between the service tool 102 and the distal annulus 112. Further, in at least one embodiment, the packer 104 may be disposed axially between the first and second sleeve ports 129, 130 of the sand screen assembly 106. The service tool 102 may seal with the interior of the packer 104. Accordingly, if the service tool 102 provides a separate, e.g., internal, flowpath between the first and second sleeve ports 129, 130, fluid communication "around" the packer 104, through the service tool 102, may be provided between the proximal annulus 110 and the distal annulus 112. Otherwise, the packer 104 and the service tool 102 may prevent communication between the proximal annulus 110 and the distal annulus 112.

The sand screen assembly 106 may further include a sand screen 132, which may extend at least partially along a portion 134 of the wellbore 101 that is distal to the casing 108, sometimes referred to as an "open hole" region. The sand screen assembly 106 may further include one or more inflow control devices, valves, etc., so as to control the formation of a gravel pack 136 and/or aid in treatment, production, etc., as will be readily appreciated by one with skill in the art.

In an example of operation of the gravel packing system 100, with the service tool 102, the packer 104, and the sand screen assembly 106 deployed into ("run in") to the wellbore 101, the packer 104 may be expanded and the ball 126 deployed to the ball seat 124 (e.g., the ball 126 deployment may allow for setting of the packer 104, as described above), leaving the service tool 102 in a set-down, circulate position, as shown in FIG. 1A. In this position, gravel packing operations may commence. Accordingly, a slurry of gravel packing material and carrier fluid may be deployed through the central bore 113 and to the ball 126, as indicated by arrow 200.

Blocked from proceeding further axially through the central bore 113 by the ball 126, the slurry may then proceed radially outward through the second tool port 128, as indicated by arrow 202. The service tool 102 may be positioned such that the second tool port 128 is below the packer 104, and fluidly communicates with the second sleeve port 130. For example, the second tool port 128 and the second sleeve port 130 may be aligned with seals 131, 133 configured to direct flow therebetween and prevent flow along the outer diameter 119 of the service tool 102. Accordingly, as also indicated by arrow 202, the slurry may flow out of the service tool 102 via the second tool port 128 and the second sleeve port 130 and into the distal annulus 112. As indicated by arrow 204, the slurry may proceed in the wellbore 101, through the distal annulus 112 to the sand screen 132.

When the slurry reaches the sand screen 132, it may be urged radially inward, e.g., by a reduced pressure in the central bore 113 below the ball 126. However, the gravel packing material may generally be blocked from proceeding through the sand screen 132, while the carrier fluid generally is allowed to flow past. Accordingly, the carrier fluid may separate from the gravel packing material, leaving the gravel packing material from the slurry in the distal annulus 112, thus forming the gravel pack 136.

The carrier fluid, separated from the gravel packing material, may be received through the sand screen 132 and may proceed in the central bore 113 toward the ball 126, as indicated by arrow 206. The ball 126 may, however, be acted upon by pressure from the gravel slurry continuing to be pumped down the central bore 113 from the surface, and thus serves to block the "upward" (toward the surface along the wellbore 101) flow in the central bore 113. Accordingly, the fluid may be directed to the bore port 120 and into the conduit 114, as indicated by arrow 208. The fluid may then proceed through the conduit 114, passing through the flow restrictor 122, which induces the first, relatively low, pressure drop.

Thereafter, the carrier fluid may flow out of conduit 114 via the first tool port 118, out of the sand screen assembly 106 via the first sleeve port 129, and into the proximal annulus 110, as indicated by arrow 210. The carrier fluid may then proceed back to the surface of the wellbore 101. When the gravel pack 136 extends to its desired point, e.g., at or above the top of the sand screen 132, gravel packing may be complete. This may be evidenced by a "screen out," whereby the pressure head experienced at the slurry pump increases, indicating that the sand screen 132 is fully gravel packed.

Once gravel packing is complete, it may be desired to clean the proximal annulus 110, i.e., remove any particulate matter, debris, etc., that may have built up therein, e.g., during gravel packing operations. To do so, in one example, the service tool 102 may be partially retracted from the sand screen assembly 106 and the packer 104, such that it is moved "up" (toward the surface along the wellbore 101) in the wellbore 101 relative to the sand screen assembly 106 and the packer 104, as shown in FIG. 1B. This retracted position may be referred to as the reverse circulation position for the service tool 102. Accordingly, the second tool port 128 of the service tool 102 may be in fluid communication with, e.g., aligned with, the first sleeve port 129 of the sand screen assembly 106.

A reverse flow of cleaning fluid may then be deployed to the proximal annulus 110, as indicated by arrow 302. A majority of the fluid flow in the proximal annulus 110 may proceed into the central bore 113 of the service tool 102 via the first sleeve port 129 of the sand screen assembly 106 and the second tool port 128 of the service tool 102, as indicated by arrow 304. This flow of fluid into the central bore 113 may carry any particles deposited in the proximal annulus 110 during the gravel packing operations or at any other time out of the proximal annulus 110. The fluid (and any particulate matter, debris, etc.) received into the central bore 113 may flow through the central bore 113 and back to the wellbore 101 surface, as indicated by arrow 306. In various embodiments, the cleaning fluid may be an acid, water, or any other suitable fluid, mixture, suspension, etc. Thereafter, the circulating cleaning fluid (and any remaining removed deposits) may be transported through the central bore 113, back to the surface of the wellbore 101.

The majority of the circulating cleaning fluid flow may be blocked from proceeding through the first tool port 118 and through the conduit 114 in the second direction by the flow restrictor 122. This may prevent most of the reversing fluid from bypassing the ball 126 and proceeding down the central bore 113 toward the gravel pack 136 in the reverse direction. The flow restrictor 122 imposing the second, relatively high pressure loss to the flow provides such flow restriction, such that the majority of the cleaning fluid passes by the first tool port 118 and proceeds along the path of least "resistance" to the second tool port 128, but may not completely cut off fluid communication. Thus, during reverse circulation, the proximal annulus 110 and the distal annulus 112 may remain in fluid communication via the conduit 114 and through the flow restrictor 122, such that high pressure swings in the distal annulus 112 may be avoided.

Accordingly, as can be appreciated by viewing the position of the service tool 102 between FIGS. 1A and 1B, for reverse circulation, the service tool 102 may be partially removed from the area distal the packer 104. If fluid communication in the central bore 113 is completely blocked during this time, the removal of the service tool 102 may apply a negative pressure (i.e., a radially inward directed pressure) on the gravel pack 136. However, with fluid communication provided through the conduit 114 via the flow restrictor 122, such negative pressure differential may be avoided or at least reduced.

Moreover, during such reverse circulation, clean-up operations, it may be advantageous to move the service tool 102 across a range of positions in the wellbore 101, for example, in a reciprocating motion. This may provide more effective clean-up in the proximal annulus 110. However, if the proximal and distal annuli 110, 112 are prevented from fluid communication, such reciprocating motion of the service tool 102 may have a piston-like effect in the distal annulus 112, pushing and pulling fluid into and out of the sand screen 132 and into interaction with the gravel pack 136. The provision of the flow restrictor 122, however, may avoid this situation, by allowing bi-directional pressure communication to be maintained between the proximal and distal annuli 110, 112, while restricting the reversing fluid from proceeding through the central bore 113 and to the distal annulus 112.

Figure 2A:
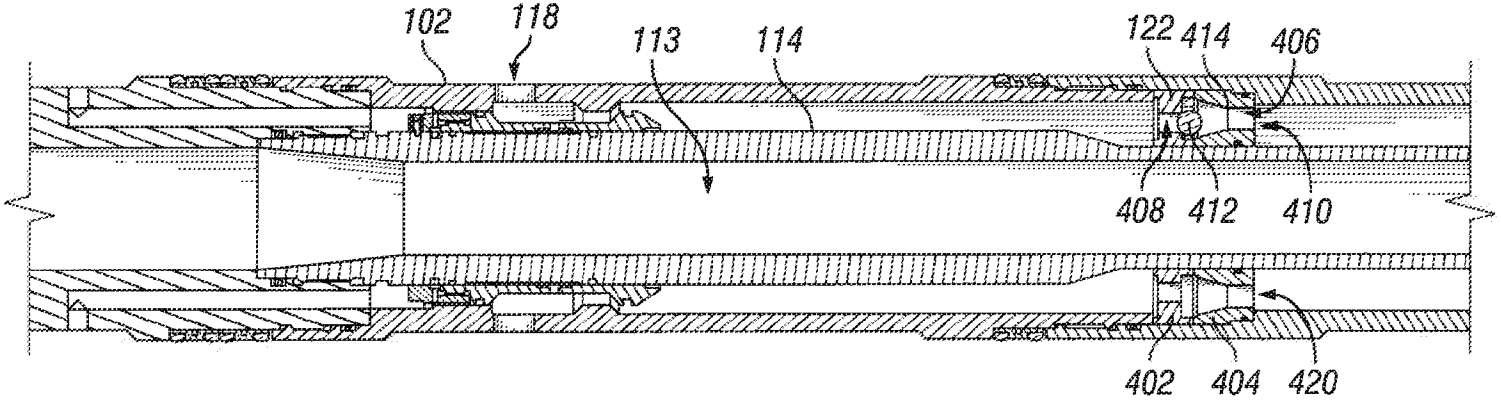
FIGS. 2A and 2B illustrate side cross-sectional views of a portion of a service tool including a flow restrictor, according to an embodiment.

FIG. 2A illustrates a cross-sectional view of a portion of the service tool 102, according to an embodiment. As shown, the service tool 102 includes the central bore 113 and the conduit 114, which extends from the first tool port 118. The service tool 102 also includes the flow restrictor 122. In an embodiment, the flow restrictor 122 includes an annular body, which may be unitary or segmented into a first disk 402 and a second disk 404, and sized to fit in the conduit 114. Further, when provided, the first and second disks 402, 404 may be configured to be concentrically positioned and coupled together, for example, face-to-face, as shown.

The flow restrictor 122 may define a plurality of primary flowpaths 406 extending axially therethrough, e.g., through the first and second disks 402, 404. The primary flowpaths 406 may be at least partially defined as openings 408, 410 in the first and second disks 402, 404, respectively. It will be appreciated that the openings 408, 410 need not have circular cross-sections but may take any shape desired. The flow restrictor 122 may also include a plurality of valve elements 412, which, in an embodiment, may be disposed at least partially within flow restrictor 122, e.g., in the flowpaths 406, as shown. In the illustrated embodiment, the valve elements 412 are balls; however, the use of balls as the valve elements 412 is one embodiment among many contemplated. In embodiments that employ balls for the valve elements 412, the balls may be metal, elastomeric, ceramic, or a combination thereof and may be erosion resistant and selected so as to have a low density, allowing them to be moved under low pressures.

Figure 2B:
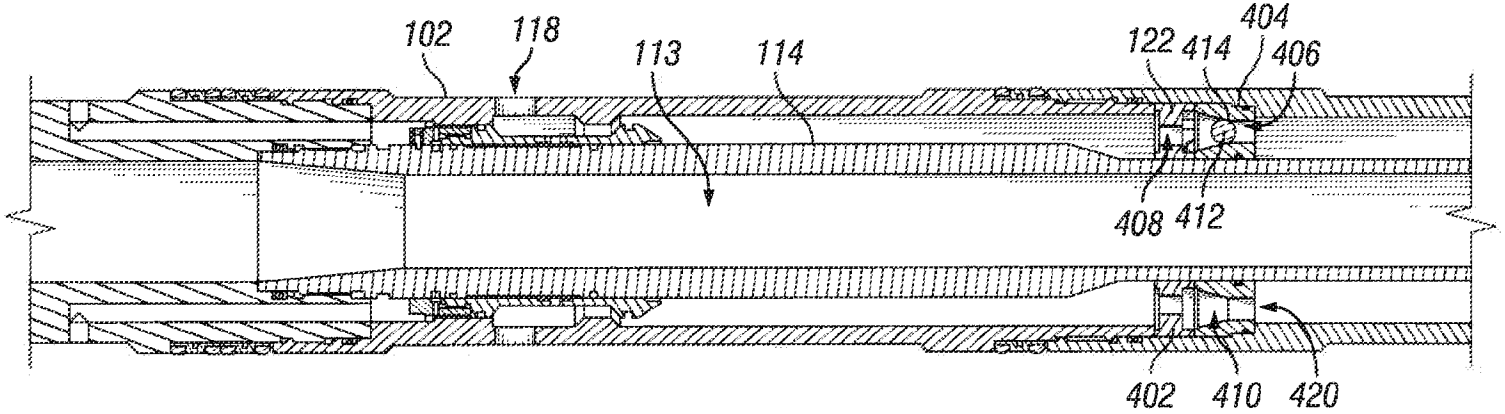

Each valve element 412 may have an open position (FIG. 2A) and a closed position (FIG. 2B). For example, in the illustrated embodiment, the second disk 404 may provide a valve seat 414. Accordingly, when fluid flows through the conduit 114, from the first tool port 118, the valve element (e.g., ball) 412 may seat in the valve seat 414 and seal therewith to prevent fluid flow through the primary flowpath 406. Further, fluid flow may be allowed in the opposite direction in the conduit 114, toward the first tool port 118, via the primary flowpaths 406, as the valve element 412 may be lifted away from the valve seat 414. Accordingly, with respect to the primary flowpaths 406 illustrated, the flow restrictor 122 may act as a check valve, allowing one-way fluid flow.

The flow restrictor 122 may also include one or more secondary flowpaths 420. The secondary flowpaths 420 may allow bi-directional fluid flow and, accordingly, may be free from valve elements. The secondary flowpaths 420 may, however, include one or more flow control devices, such as nozzles, orifices, etc., which may be replaceable to allow selectable flow rates and/or pressure drops, for example. The flow control devices will be described in greater detail below.

Referring again to the gravel packing and reverse circulation, clean-up operations shown in and described above with reference to FIGS. 1A and 1B, during gravel packing, the carrier fluid, after separation from the gravel packing material outside of the sand screen 132, may proceed in the first direction through the conduit 114, i.e., from the bore port 120 and toward the first tool port 118 via the primary and secondary flowpaths 406, 420 defined in the flow restrictor 122. With both types of flowpaths 406, 420 allowing fluid flow, the pressure drop in the carrier fluid across the flow restrictor 122 may be minimized. However, fluid flow during reverse circulation may be restricted from flowing through the conduit 114 in the second direction, away from the first tool port 118, by the flow restrictor 122. More particularly, in the primary flowpaths 406, the valve elements 412 may be urged into the valve seats 414 when fluid flows from the first tool port 118. Accordingly, the primary flowpaths 406 may be closed. However, a controlled amount of fluid may pass through the flow restrictor 122 via the secondary flowpaths 420.

Thus, the pressure drop across the flow restrictor 122 in the second direction may be relatively high compared to the pressure drop in the first direction, but fluid communication may continue to be provided through the conduit 114. Accordingly, during reverse circulation, clean-up operations, the proximal and distal annuli 110, 112 may remain in constant fluid communication via at least the secondary flowpaths 420. Thus, pressure fluctuations induced by the movement of the service tool 102 in the wellbore 101 may be reduced.

Figure 3B:
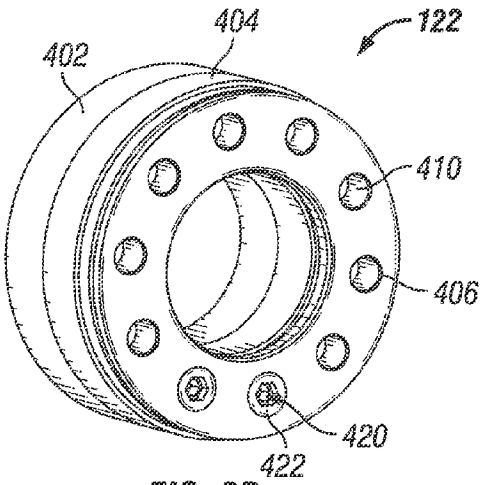
FIG. 3B illustrates a perspective view of another embodiment of the flow restrictor.
Figure 3A:
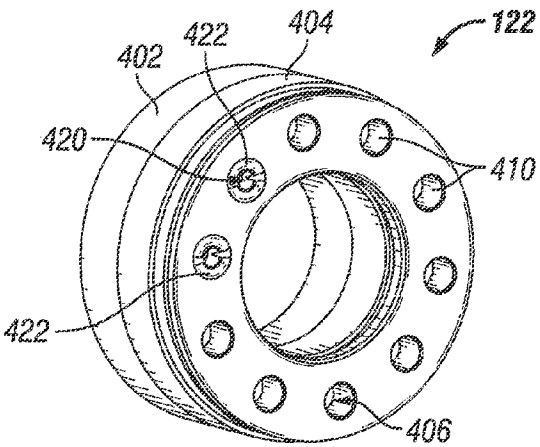
FIG. 3A illustrates a perspective view of the flow restrictor, according to an embodiment.

FIGS. 3A and 3B illustrate perspective views of two embodiments of the flow restrictor 122. As shown, the second disk 404 of the flow restrictor 122 may include the openings 410 extending therethrough and partially defining the plurality of primary flowpaths 406 and the plurality of secondary flowpaths 420. Although eight primary flowpaths 406 and two secondary flowpaths 420 are illustrated, it will be appreciated that any number of either type of flowpaths 406, 420 may be provided. Further, the valve seats 414 may be aligned with each of the openings 410 that define the primary flowpaths 406 in the second disk 404, such that the valve elements 412 block fluid flow through the openings 410 of the primary flowpath 406 when seated.

The flow restrictor 122 may also include a flow control device 422 disposed in at least one of the openings 410 that partially defines the secondary flowpaths 420. For example, the flow restrictor 422 may include multiple flow control devices 422, one or more in each or at least some of the openings 410. The flow control devices 422 may be threaded, pinned, welded, adhered, press-fit, interference-fit, or otherwise coupled and/or fixed in the openings 410 that partially define the secondary flowpaths 420. In some examples, the flow control devices 422 may be readily removed from the openings 410 and replaced with differently-sized flow control devices 422, so as to adjust the operating parameters of the flow restrictor 122, as described below. In other examples, the flow control devices 422 may be permanently disposed in the openings 410, such that removal may damage or destroy the flow control device 422 or another portion of the flow restrictor 122.

In the embodiment illustrated in FIG. 3A, the flow control devices 422 are orifices. Such orifices may be constructed from drill bit tungsten carbide, hardened (e.g., case hardened) steel orifices, ceramic orifices, composite orifices, other metallic or non-metallic orifices, or the like. In the embodiment illustrated in FIG. 3B, the flow control devices 422 are nozzles. It will be appreciated that any type of flow control device 422 may be employed.

Such flow control devices 422 may allow a range of pressure drops, flow rates, and/or correspondences therebetween to be selected for the secondary flowpaths 420 of the flow restrictor 122. For example, if a greater flow rate (e.g., lower pressure drop) is desired through the secondary flowpaths 420, a larger orifice or nozzle may be selected. Accordingly, a tradeoff between allowing fluid to flow through the conduit 114 during reverse circulation versus a lower pressure drop and/or greater fluid communication through the flow restrictor 122 during gravel packing (and greater avoidance of pressure fluctuations in the distal annulus 112 of the wellbore 101) may be selected.

Additionally, any fraction of the total number of flowpaths provided may be primary flowpaths 406 and any fraction may be secondary flowpaths 420. Further, the flow restrictor 122 may be modular, such that one or more of the valve elements 412 may be removed and one or more additional flow control devices 422 may be provided to take its place, thereby converting one or more of the primary flowpaths 406 to one or more of the secondary flowpaths 420. In other embodiments, the openings 408 and/or 410 for the different types of flowpaths 406, 420 may be differently sized and/or shaped, and, thus, such reconfiguration may include additional modification to the flow restrictor 122. Additionally, it will be appreciated that, in some embodiments, one or more secondary flowpaths 420 may not include a flow control device 422. Furthermore, a single embodiment of the flow restrictor 122 may include one or more nozzles, one or more orifices, and/or one or more other types of flow control devices 422 without departing from the scope of the disclosure.

Figure 4B:
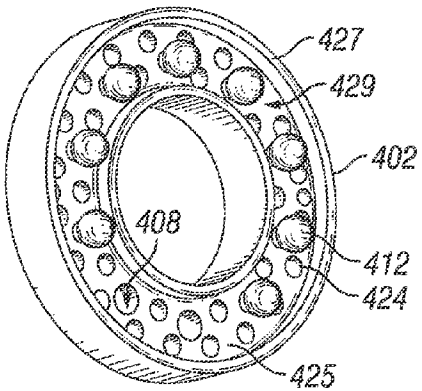
FIG. 4B illustrates a perspective view of a section of the flow restrictor, according to an embodiment.
Figure 4A:
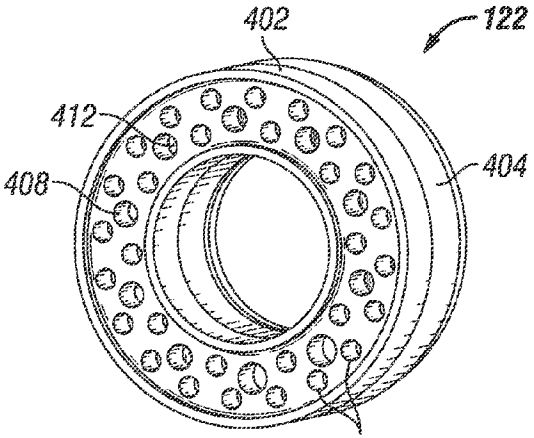
FIG. 4A illustrates a perspective view of the flow restrictor, showing the reverse axial side, according to an embodiment.

FIG. 4A illustrates a perspective view of the first disk 402 of the flow restrictor 122, according to an embodiment. FIG. 4B illustrates a perspective view of the first disk 402 of the flow restrictor 122, with the second disk 404 removed to show the interior of the flow restrictor 122, according to an embodiment. As depicted in both FIGS. 4A and 4B, the first disk 402 defines the openings 408 extending therethrough. The openings 408 may be generally coaxial with the openings 410 of the second disk 404 so as to define the primary and secondary flowpaths 406, 420. The first disk 402 may also define secondary openings 424, which may fluidly communicate with the primary flowpaths 406 and the secondary flowpaths 420.

In an embodiment, the openings 408 and 424 may be defined through a restrictor plate 425 of the first disk 402. As best shown in FIG. 4B, the restrictor plate 425 may be offset from an axial end 427 of the first disk 402. This axial offset may provide a manifold 429, allowing fluid communication at least between the secondary openings 424 and the openings 408 forming part of the primary flowpaths 406. The manifold 429 may also allow fluid communication between the secondary openings 424 and the openings 408 forming part of the secondary flowpaths 420. As such, in the primary flowpaths 406, although the openings 408 may be partially or completely obstructed by the valve elements 412 in the open position, fluid flows through the first disk 402 via the secondary openings 424. It will be appreciated that any number of secondary openings 424 may be provided for each of the primary flowpaths 406 and/or each of the secondary flowpaths 420.

Figure 5A:
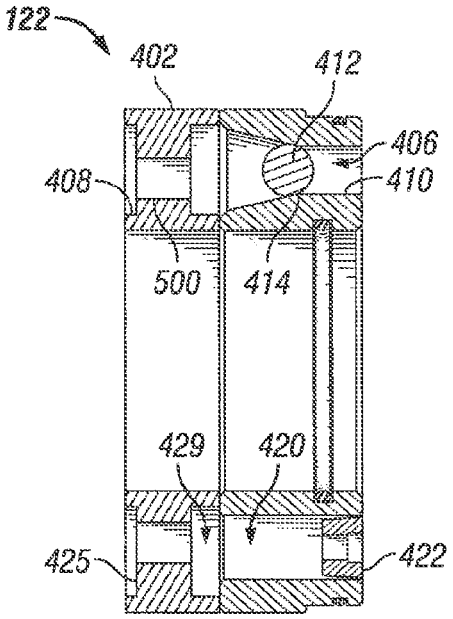
FIG. 5A illustrates a side cross-sectional view of the flow restrictor, according to an embodiment.
Figure 5B:
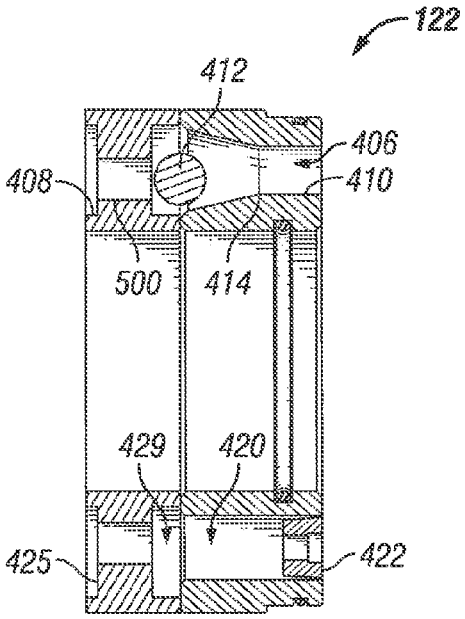
FIG. 5B illustrates a side cross-sectional view of another embodiment of the flow restrictor.

FIGS. 5A and 5B illustrate cross-sectional views of two embodiments of the flow restrictor 122. More particularly, FIGS. 5A and 5B each illustrate one primary flowpath 406 and one secondary flowpath 420. The flow restrictor 122 includes the valve element 412, in the form of a ball, in the primary flowpath 406 and the flow control device 422, in the form of an orifice, in the secondary flowpath 420. The second disk 404 defines the valve seat 414 in the opening 408, providing a tapered surface that snugly receives the valve element 412 to form a seal therewith, such that the valve element 412, seated in the valve seat 414, is in a closed position, substantially preventing fluid flow through the primary flowpath 406, as shown in FIG. 5A.

In some embodiments, the openings 410 defining the secondary flowpaths 420 in the second disk 404 may omit the valve seat. Instead, the openings 410 defining the secondary flowpaths 420 in the second disk 404 may be cylindrical bores, or any other convenient shape, since sealing with a valve element may not be provided. In other embodiments, the openings 410 may be uniformly shaped, regardless of whether each of the openings 410 partially defines one of the primary or a secondary flowpaths 406, 420.

Moreover, in the embodiment illustrated in FIG. 5B, the opening 408 defined in the first disk 402 is generally formed as a cylindrical bore 500 extending through the restrictor plate 425 from the manifold 429. The bore 500 may have a radius that is less than that of the valve element 412. Accordingly, when fluid flows in a direction from the second disk 404, toward the first disk 402, the valve element 412 may be lifted out of the valve seat 414 and prevented from travelling through the opening 408 by the size of the bore 500. However, the valve element 412 may not seat against the bore 500, but may instead move around in the manifold 429, between the valve seat 414 and the restrictor plate 425.

Figure 6A:
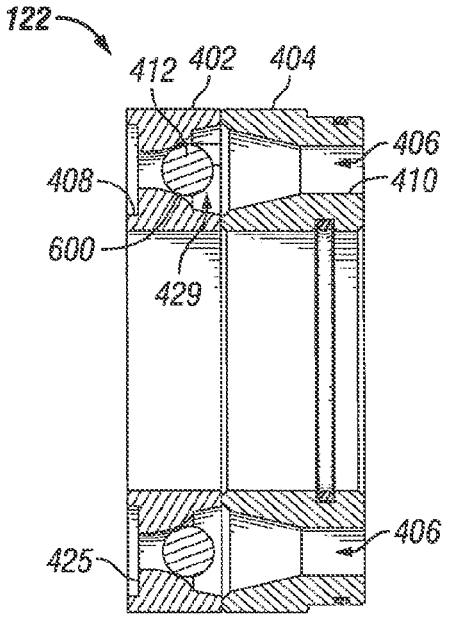
FIG. 6A illustrates a side cross-sectional view of the flow restrictor, according to an embodiment.
Figure 6B:
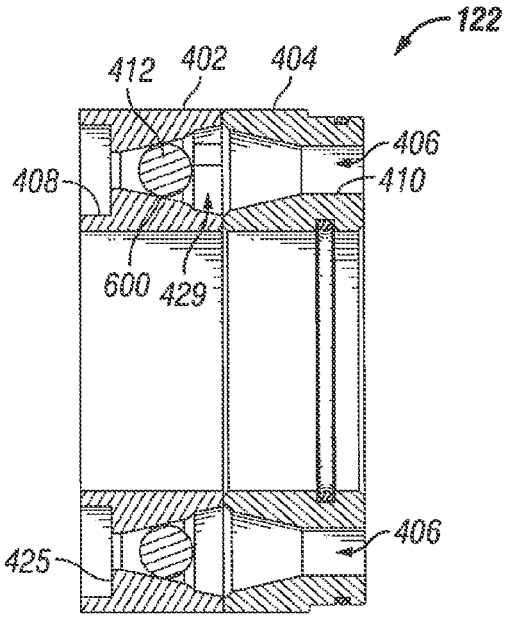
FIG. 6B illustrates a side cross-sectional view of another embodiment of the flow restrictor.

FIGS. 6A and 6B illustrate cross-sectional views of two embodiments of the flow restrictor 122. In some applications, movement of the valve element 412 while in the open position may be undesired. As such, the flow restrictor 122 may include a second valve seat 600 defined in the restrictor plate 425 of the first disk 402. Accordingly, when in the open position, the valve element 412 in the primary flowpath 406 may generally be held stationary in the second valve seat 600 by fluid pressure. FIG. 6B illustrates a similar embodiment, except that the second valve seat 600 is deeper (i.e., extends farther into the restrictor plate 425 and may have a more gradual taper), such that the valve element 412 may be disposed in, e.g., completely within, the restrictor plate 425 when in the closed position. As such, the valve element 412 may avoid impeding flow in the manifold 429 as between the secondary openings 424 (FIGS. 4A and 4B) and/or the openings 408. Such avoidance of obstruction to the manifold 429 may allow a further reduction the second pressure drop.

Figure 7:
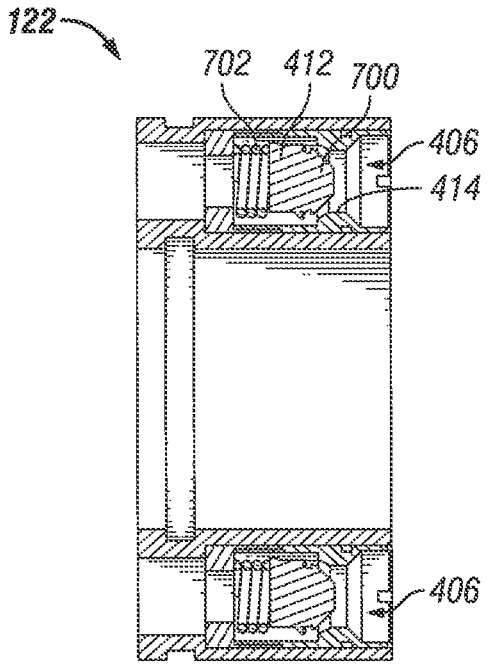
FIG. 7 illustrates a side cross-sectional view of yet another embodiment of the flow restrictor.

FIG. 7 illustrates a side cross-sectional view of another embodiment of the flow restrictor 122. As shown, the valve element 412 of the flow restrictor 122 need not be a ball, but may instead include a plug 700. Further, the illustrated valve element 412 may include a biasing member 702, which biases the plug 700 toward the valve seat 414. The biasing member 702 may be a spring, such as a helical compression spring, tension spring, etc. In a closed position, the plug 700 may seal with the valve seat 414, preventing flow therethrough.

Accordingly, the illustrated primary flowpaths 406 may be closed, i.e., preventing flow from the first tool port 118 and through the conduit 114 (left-to-right, as shown in FIG. 7), when the plug 700 fits into the valve seat 414. When flow proceeds in the opposite direction, it may provide sufficient force on the plug 700 to overcome the force applied by the biasing member 702, thereby lifting the plug 700 away from the valve seat 414.

Figure 8:
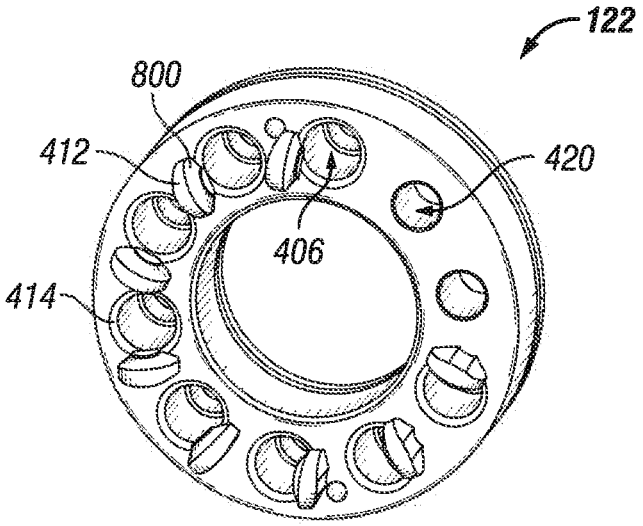
FIG. 8 illustrates a raised perspective view of still another embodiment of the flow restrictor.

FIG. 8 illustrates a perspective view of yet another embodiment of the flow restrictor 122. As shown, the valve elements 412 for the primary flowpaths 406 may be flappers 800. The flappers 800 may be sized and configured to seal with the valve seat 414, which may be formed in the first disk 402. In at least one embodiment, the valve seat 414 may be provided by a beveled area of the opening 408, while the flapper 800 may include a complementary taper, configured to seal with the bevel of the valve seat 414. Additionally, in at least one embodiment, the flapper 800 may be biased, e.g., using a torsion spring, pivotally toward the valve seat 414. Using the flapper 800, the flow restrictor 122 may thus achieve the one-direction flow in the primary flowpaths 406. Further, as shown, the secondary flowpaths 420 may omit such a valve element 412, such that fluid is able to progress in either direction through the secondary flowpaths 420.

Figure 9:
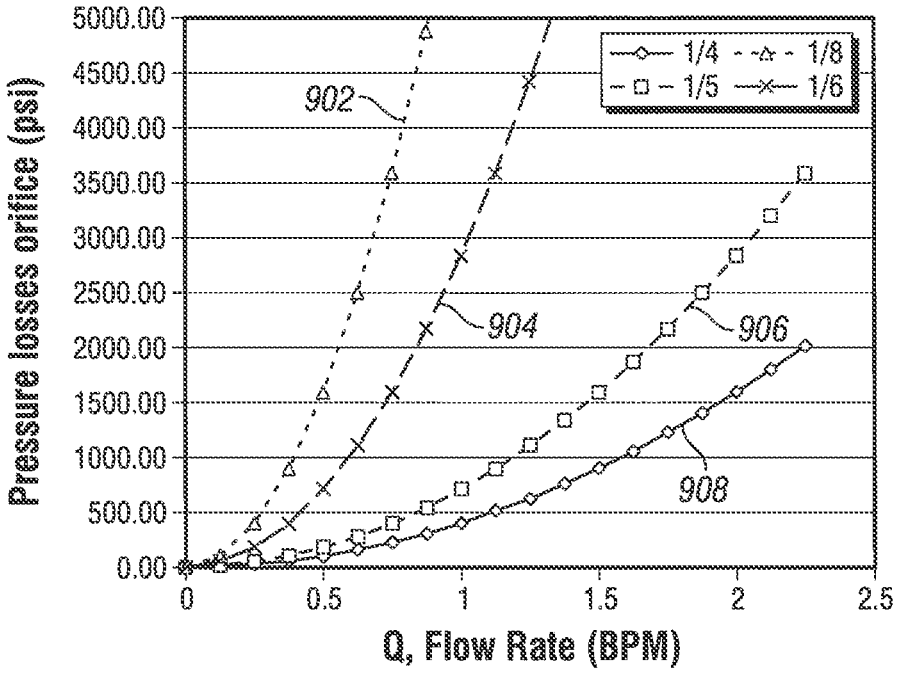
FIG. 9 illustrates a plot of pressure drops in flow through the restrictor during reverse circulation operations, according to an embodiment.

FIG. 9 illustrates a plot of an experimental embodiment of the flow restrictor 122 including two secondary flowpaths 420. In this embodiment, a flow control device 422, in the form of an orifice, is positioned in both of the secondary flowpaths 420. Line 902 plots an embodiment in which the orifice is size ⅛ of an inch (3.175 mm). Line 904 plots an embodiment in which the orifice is size ⅙ of an inch (4.23 mm). Line 906 plots an embodiment in which the orifice is size ⅕ of an inch (5.08 mm). Line 908 plots an embodiment in which the orifice size is ¼ of an inch (6.35 mm). As can be appreciated, pressure losses through the flow restrictor 122 may increase with smaller flow orifices sizes, if the number of orifices remains the same, due at least in part to the reduced flowpath area.

The lines 902-908 may be derived from the orifice equations, resulting from:

$$Q = C_D A_1 \sqrt{\frac{2(P_1 - P_2)}{\rho\left(1 - \left(\frac{A_2}{A_1}\right)^2\right)}} = C_D A_2 \sqrt{\frac{2(P_1 - P_2)}{\rho\left(1 \left(\frac{d}{D}\right)^4\right)}} = C_D A_2 \sqrt{\frac{2(P_1 - P_2)}{\rho(1 - (\beta)^4)}}. \quad (1)$$

Where:

Q≡Volumetric flow rate $A_1$≡Area of the pipe $A_2$≡Area of the orifice $P_n$≡Upstream ($P_1$) and Downstream ($P_2$) Pressure $C_d$≡Discharge Coefficient, which may be experimentally determined from testing.

D≡Pipe Diameter d≡Orifice Diameter

β≡Diameter Ratio, smaller orifice diameter/larger pipe diameter

ρ≡Density of the fluid

V≡Velocity

Accordingly, it can be seen that a particular pressure drop, with an appropriate flow rate through the secondary flowpaths 420 during reverse circulation (i.e., when the primary flowpaths 406 are closed), can be provided by selecting an appropriately-sized orifice (or another type of flow control device 422). However, it will be appreciated that equation (1) may be employed for calculating, or at least approximating, flow rate in circular orifice flows. If an orifice having another shape, e.g., an annular orifice, or another flow restrictor, is placed in line, flow parameters may be calculated using different characteristic equations.

Figure 10:
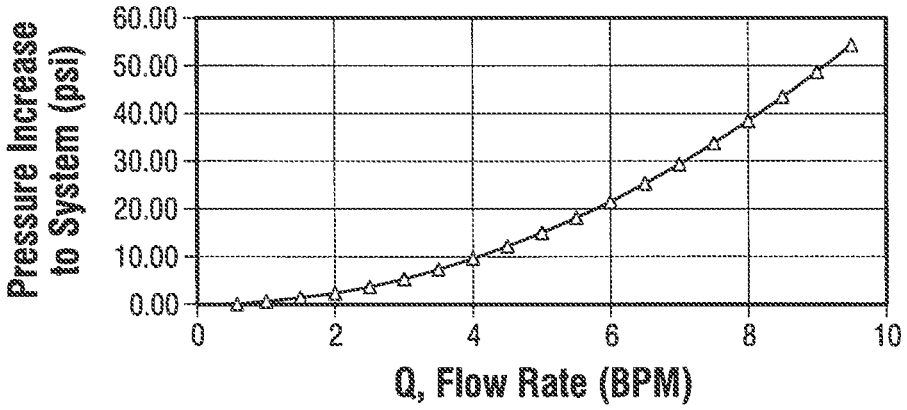
FIG. 10 illustrates a plot of pressure drops in flow through the restrictor during gravel packing operations, according to an embodiment.

FIG. 10 illustrates a plot showing the second pressure drop as a function of flow rate through an embodiment of the flow restrictor 122, e.g., during gravel packing operations. As can be appreciated, the flow restrictor 122 may provide a relatively small amount of pressure drop during gravel packing operations as compared to during reverse circulation shown in FIG. 9. For example, the pressure drop may be less than about 50 psi (345 kPa) at flow rates of less than or equal to about nine barrels per minute (BPM).

Minimizing the second pressure drop during gravel packing may be desired because increases in the pressure drop in the gravel slurry may necessitate higher pressures in the slurry, so as to maintain a desired flow rate. However, higher pressures in the gravel slurry may result in a short-circuiting of the gravel slurry through the sand screen 132. As the pressures in the gravel slurry are increased, the carrier fluid may separate from the gravel more quickly than desired, proceeding through the sand screen 132 before desired. This may lead to uneven gravel packing, shorter possible gravel packs, voids, or other undesired results. For example, in some situations, every approximately 100 psi (689 kPa) increase in pressure in the gravel slurry may reduce the available coverage of the gravel pack by about 500 feet (152 m).

Accordingly, using the flow restrictor 122 in the conduit 114, the proximal and distal annuli 110, 112 may remain in fluid communication in both the set-down, circulate position and the reverse circulation positions for the service tool 102. This may reduce the potential for "swabbing" or otherwise damaging the formation during movement of the service tool 102. Further, the flow restrictor 122 substantially inhibits flow therethrough during reverse circulation operations, thereby retaining this functionality and, for example, avoiding a need for a full bore ball or check valve preventing fluid flow in the internal central bore 113 of the service tool 102 during such operations. However, unlike a full bore check or ball valve, the flow restrictor 122, without further actuation, may also not substantially interfere with gravel packing operations, since it exhibits a low pressure loss at high flow during such gravel packing operations.

Figure 11:
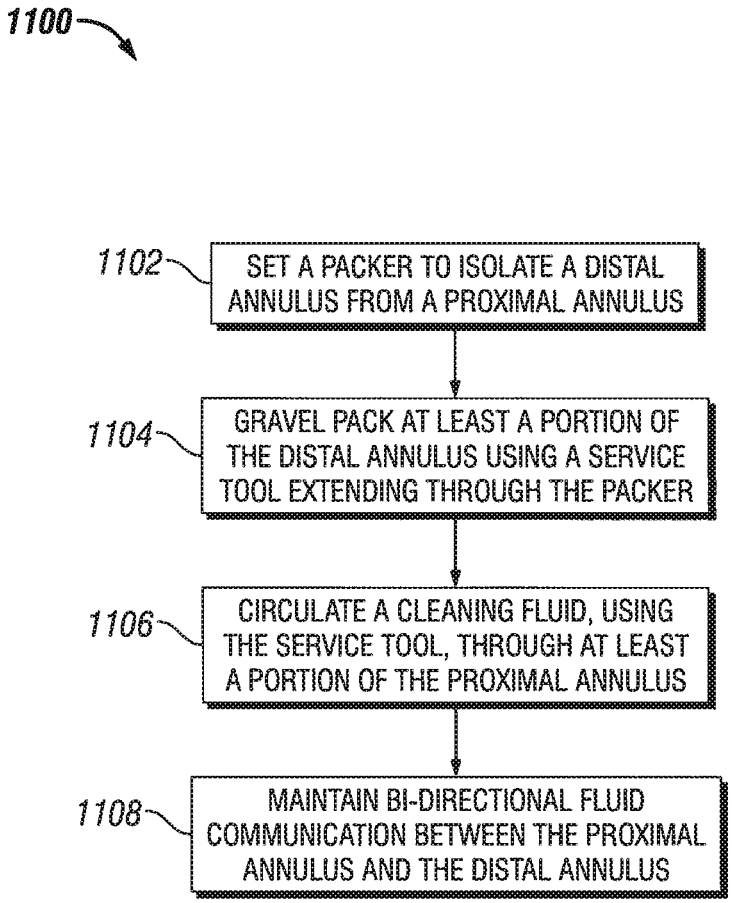
FIG. 11 illustrates a flowchart of a method for gravel packing a portion of a wellbore, according to an embodiment.

FIG. 11 illustrates a flowchart of a method 1100 for gravel packing at least a portion of a wellbore. The method 1100 may proceed by operation of one or more embodiments of the gravel packing system 100 and may thus be best understood with reference thereto. Further, the method 1100 may begin by setting a packer to isolate a distal annulus from a proximal annulus, as at 1102. The method 1100 may proceed to gravel packing at least a portion of the distal annulus using a service tool extending through the packer, as at 1104. The service tool may include a conduit in fluid communication with the proximal annulus and the distal annulus. Further, the service tool may include a flow restrictor disposed in the conduit.

After gravel packing, then method 1100 may proceed to circulating a cleaning fluid, using the service tool, through at least a portion of the proximal annulus, as at 1106. The flow restrictor may restrict a flow of the cleaning fluid through the conduit while circulating the cleaning fluid at 1106. Further, the method 1100 may include maintaining bi-directional fluid communication between the proximal annulus and the distal annulus via the conduit, as at 1108. For example, such communication may be maintained at least while cleaning out at 1106. In various embodiments, maintaining the bi-directional communication at 1108 may be continuous applied, during gravel packing at 1104 and/or during cleaning out operations at 1106.

In an embodiment, gravel packing at 1104 may include inducing a first pressure drop in the carrier fluid using the flow restrictor, while circulating the cleaning fluid at 1106 induces a second pressure drop in the cleaning fluid using the flow restrictor. The first pressure drop may be less than the second pressure drop. Further, inducing the first pressure drop may include opening a primary flowpath through the flow restrictor such that fluid flows through the primary flowpath and through a secondary flowpath extending through the flow restrictor. Additionally, inducing the second pressure drop may include closing the primary flowpath such that fluid flows through the secondary flowpath but is substantially blocked from flowing through the primary flowpath. Furthermore, the method 1100 determining a value for the second pressure drop, and selecting one or more flow control devices to regulate flow in the second direction through the secondary flowpath such that the value for the second pressure drop is provided.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure. Finally, it will be appreciated that any one implementation of the flow restrictor 122 may combine elements of any of the embodiments of the valve element 412 and/or any other suitable type of valve element 412.

What is claimed is:

1. A system for gravel packing at least a portion of a wellbore, comprising:

a service tool extending through a packer that isolates a proximal annulus of the wellbore from a distal annulus thereof, the service tool defining an inner bore and a conduit, the conduit being in fluid communication with the proximal annulus and the distal annulus; and a flow restrictor disposed in the conduit, wherein the flow restrictor defines:

one or more primary flowpaths extending therethrough, wherein fluid flow is allowed through the one or more primary flowpaths in a first direction, and fluid flow is substantially blocked through the one or more primary flowpaths in a second direction; and one or more secondary flowpaths extending therethrough, wherein fluid flow is allowed through the one or more secondary flowpaths in both the first and second directions, and wherein the flow restrictor is configured to induce a first pressure drop in fluid flowing through the conduit in the first direction and to induce a second pressure drop in fluid flowing through the conduit in the second direction, wherein the second pressure drop is greater than the first pressure drop.

2. The system of claim 1, wherein the first direction proceeds from the distal annulus to the proximal annulus, and the second direction proceeds from the proximal annulus to the distal annulus.

3. The system of claim 1, wherein the fluid flow in the first direction corresponds to gravel packing operations and fluid flow in the second direction corresponds to reverse circulation operations.

4. The system of claim 1, wherein the flow restrictor comprises one or more valve elements, the one or more valve elements being disposed in the one or more primary flowpaths, such that fluid flow is allowed through the one or more primary flowpaths in the first direction and fluid flow is substantially blocked through the one or more primary flowpaths in the second direction.

5. The system of claim 1, wherein the flow restrictor further comprises one or more flow control devices disposed in the one or more secondary flowpaths.

6. The system of claim 5, wherein the one or more flow control devices each comprise a nozzle, an orifice, or a combination thereof.

7. The system of claim 1, wherein the conduit is in fluid communication with the distal annulus via at least a portion of the inner bore.

8. The system of claim 1, wherein the first pressure drop is between about 10 MPa and about 25 MPa.

9. The system of claim 1, wherein the second pressure drop is less than about 700 kPa.

10. An apparatus for restricting flow in a conduit of a gravel packing system, comprising:

an annular disk defining:

a first opening extending therethrough, wherein the first opening define a primary flowpath;

a second opening extending therethrough, wherein the second opening defines a secondary flowpath;

a third opening extending at least partially therethrough; and a manifold that provides communication between the first opening and the third opening, the second opening and the third opening, or both; and a valve element disposed in the first opening, the valve element being configured to substantially block fluid from flowing through the primary flowpath in a first direction, and to allow fluid to flow through the primary flowpath in a second direction, wherein the secondary flowpath allows fluid flow therethrough in both the first and second directions.

11. The apparatus of claim 10, wherein the annular disk comprises a valve seat positioned in the first opening defining the primary flowpath, wherein the valve seat is configured to receive and seal with the valve element so as to block fluid flow through the primary flowpath in the first direction.

12. The apparatus of claim 10, wherein the valve element is a ball, a flapper, a plug, or a combination thereof.

13. The apparatus of claim 10, wherein annular disk comprises:

a first disk defining at least a portion of the first, second, and third openings; and a second disk disposed concentrically to the first disk and coupled therewith, the second disk defining at least a portion of the first and second openings and defining a valve seat in the first opening defining the primary flowpath.

14. The apparatus of claim 13, wherein the manifold is defined between at least a portion of the first disk and at least a portion of the second disk, and wherein the manifold provides communication between the first opening and the third opening.

15. The apparatus of claim 14, wherein the first disk defines a second valve seat in the first opening defining the primary flowpath, the second valve seat being configured to receive the valve element, wherein, when the second valve seat receives the valve element, the valve element is at least partially outside of the manifold.

16. The apparatus of claim 13, wherein the manifold is defined between at least a portion of the first disk and at least a portion of the second disk, and wherein the manifold provides communication between the second opening and the third opening.

17. A method for gravel packing at least a portion of a wellbore, comprising:

setting a packer to isolate a distal annulus from a proximal annulus;

gravel packing at least a portion of the distal annulus using a service tool extending through the packer, wherein the service tool includes a conduit in fluid communication with the proximal annulus and the distal annulus, wherein the service tool includes a flow restrictor disposed in the conduit, wherein the flow restrictor includes a primary flowpath extending therethrough and a secondary flowpath extending therethrough, and wherein fluid flows through the primary flowpath and the secondary flowpath in a first direction as the at least a portion of the distal annulus is gravel packed; and after gravel packing, circulating a cleaning fluid, using the service tool, through at least a portion of the proximal annulus, wherein the cleaning fluid flows through the secondary flowpath in a second, opposing direction, but is substantially blocked from flowing through the primary flowpath in the second, opposing direction, as the cleaning fluid is circulated.

18. The method of claim 17, wherein:

gravel packing comprises inducing a first pressure drop in the fluid using the flow restrictor; and circulating the cleaning fluid comprises inducing a second pressure drop in the cleaning fluid using the flow restrictor, wherein the first pressure drop is less than the second pressure drop.

19. The method of claim 18, wherein:

inducing the first pressure drop comprises opening the primary flowpath through the flow restrictor such that the fluid flows through the primary flowpath and through the secondary flowpath extending through the flow restrictor; and inducing the second pressure drop comprises closing the primary flowpath such that the cleaning fluid flows through the secondary flowpath but is substantially blocked from flowing through the primary flowpath.

20. The method of claim 19, further comprising:

determining a value for the second pressure drop; and selecting one or more flow control devices to regulate flow in the second direction through the secondary flowpath such that the value for the second pressure drop is provided.

* * * * *